United States Patent [19]

Tate

[11] 4,359,801

[45] Nov. 23, 1982

[54] PICK-UP HEAD FOR SURFACE CLEANING APPARATUS

[76] Inventor: Jimmy W. Tate, P.O. Box 325, Anniston, Ala. 36202

[21] Appl. No.: 260,333

[22] Filed: May 4, 1981

[51] Int. Cl.[3] ..... E01H 1/08

[52] U.S. Cl. ..... 15/346

[58] Field of Search ..... 15/345, 346

[56] References Cited

U.S. PATENT DOCUMENTS

| | | | |
|---|---|---|---|
| 3,512,206 | 5/1970 | Young | 15/346 |
| 3,662,427 | 5/1972 | Hanna | 15/346 |
| 4,109,341 | 8/1978 | Larsen et al. | 15/346 X |
| 4,110,864 | 9/1978 | Gunnarsson | 15/346 X |

*Primary Examiner*—Chris K. Moore

*Attorney, Agent, or Firm*—Woodford R. Thompson, Jr.

[57] ABSTRACT

A pick-up head for surface cleaning apparatus embodies a horizontal baffle extending between depending side walls of an elongated, downwardly opening chamber. Upper and lower horizontally extending air flow passageways are defined by the baffle within the pick-up head, with air in the lower passageway flowing over and contacting a surface to be cleaned. The upper passageway is restricted at its outlet to create a venturi effect as air passes therefrom. The venturi effect aids in drawing air carrying dirt and debris into the pick-up head.

8 Claims, 7 Drawing Figures

13
7
10
56
12
11
7
15
2
14
16
28
26
29
31
22
2

3
15
42
44
20
14
44
42
17
18
3
16
22
22
29
31
24c
31

5
28
44
42
51
47
14
42
44
4
4
15
17
22
26
44
49
20
44
5
22

15
37
44
42
20
14
34
42
44
38
17
18
16
54
22
22
29
31
31
52
39
46
32
36
47
48
41
53
19

PICK-UP HEAD FOR SURFACE CLEANING APPARATUS

BACKGROUND OF THE INVENTION

This invention relates to a pick-up head for air flow surface cleaning apparatus and more particularly to such a pick-up head which shall be adapted for cleaning surfaces such as roads, streets, parking lots and the like.

Heretofore in the art to which my invention relates various types of apparatus have been devised for removing debris and dirt from parking lots, streets and the like. Such apparatus has included vehicle-mounted sweepers having rotary brushes and suction equipment which dislodge and remove the dirt and debris from a surface to be cleaned and apparatus which forced air over a surface to be cleaned to thus entrain and pick up dirt and debris. Also, U.S. Pat. Nos. 3,512,206 and 3,545,181 disclose apparatus in which a longitudinal blast of air under pressure strikes the surface to be cleaned at an acute angle from the rear of the pick-up head. This blast of air moves the dirt and debris toward the front of the pick-up head in the direction of movement of the vehicle with movement of the air then being turned laterally toward the discharge end thereof. With this apparatus, portions of the blasts of air escape the pick-up head whereby lightweight litter, such as light cups, cans and the like are blown outwardly from the front and sides thereof, thus reducing the cleaning efficiency of the apparatus.

SUMMARY OF THE INVENTION

In accordance with my invention I provide an improved pick-up head for a surface cleaning apparatus which is simple of construction, economical of manufacture and efficient in operation. My improved pick-up head provides an air flow path that produces increased suction within the pick-up head whereby dust and lightweight litter are drawn inwardly of the pick-up head instead of being blown outwardly thereof. Further, I provide an elongated, downwardly opening pick-up head having a horizontal baffle extending between the sides thereof to define upper and lower passageways within the pick-up head, with air in the lower passageway flowing substantially in a single direction over and in contact with the surface to be cleaned. The cross sectional area of the upper passageway is restricted at its outlet to create a venturi effect as air passes therefrom which aids in drawing air carrying dirt and debris from the lower passageway into a suction conduit adjacent thereto.

BRIEF DESCRIPTION OF THE DRAWINGS

Apparatus embodying features of my invention is illustrated in the accompanying drawings, forming a part of this application, in which.

DETAILED DESCRIPTION

Figure 1:
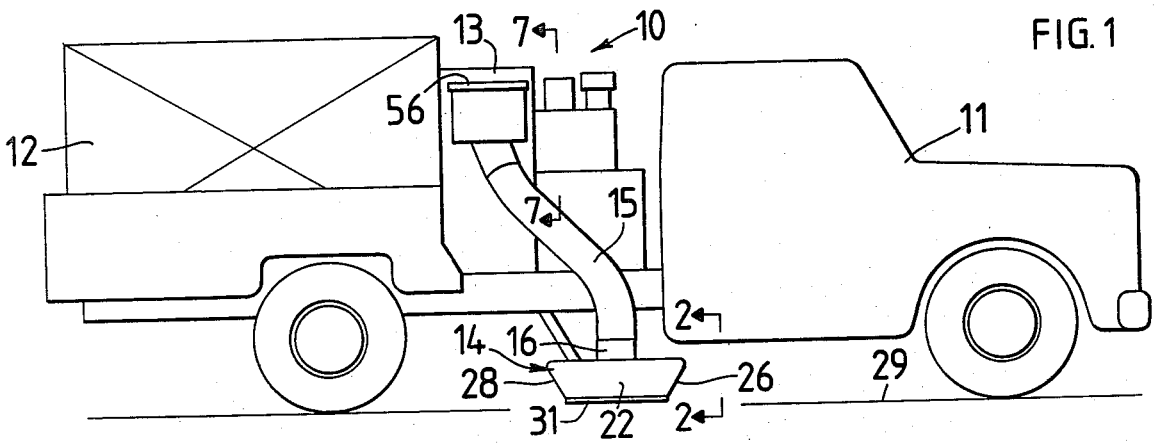
FIG. 1 is a side elevational view showing my improved pick-up head for surface cleaning apparatus mounted on a conventional truck.

Referring now to the drawings for a better understanding of my invention, I show in FIG. 1 surface cleaning apparatus indicated generally at 10 which may be mounted on a conventional motorized vehicle, such as a truck 11. The apparatus 10 includes a collection chamber 12 and air circulating means, such as a conventional centrifugal fan 13. An elongated, downwardly opening pick-up head 14 is mounted on the truck 11 and extends transversely of the direction of movement thereof. While I have shown the cleaning device 10 being carried by a conventional truck, it will be apparent that it may be transported over a surface to be cleaned by vehicles of other types. An air supply duct 15 communicates the pressure side of the fan 13 with an air inlet conduit 16 for the pick-up head 14. A second duct 17 communicates a common suction conduit 18 of the pick-up head 14 with the collection chamber 12 whereby collected dirt and debris are transported from the pick-up head 14 through the duct 17 to the collection chamber.

Figure 6:
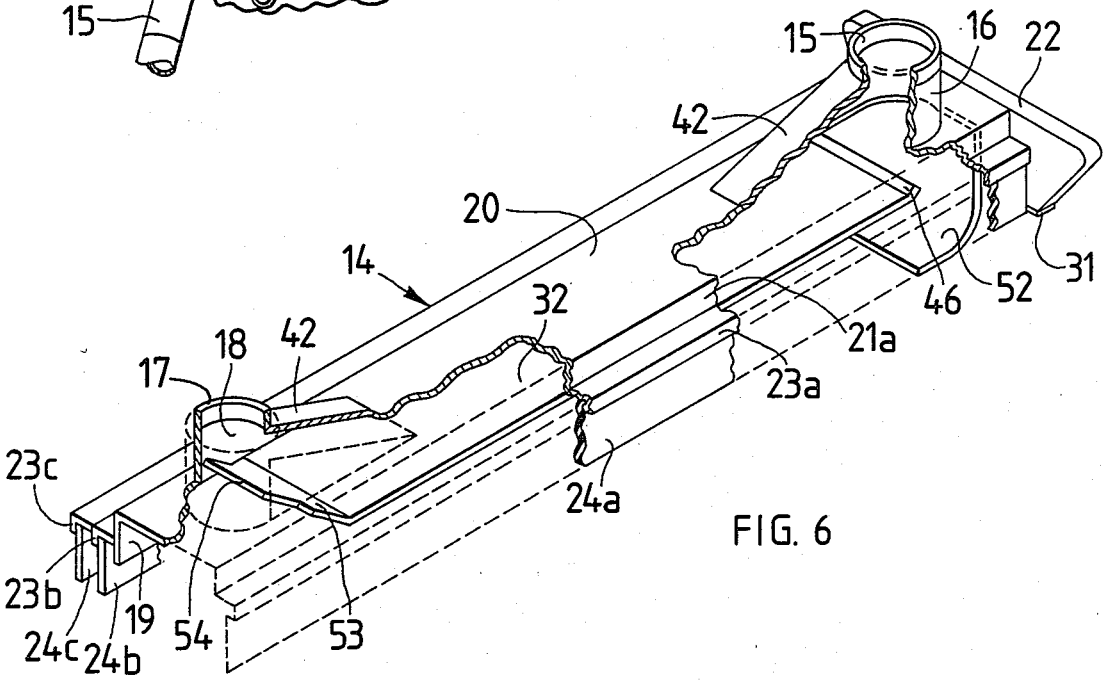
FIG. 6 is a perspective view showing the pick-up head removed from the cleaning apparatus shown in FIG. 1; and, FIG. 7 is a fragmental view taken generally along the line 7—7 of FIG. 1.
Figure 5:
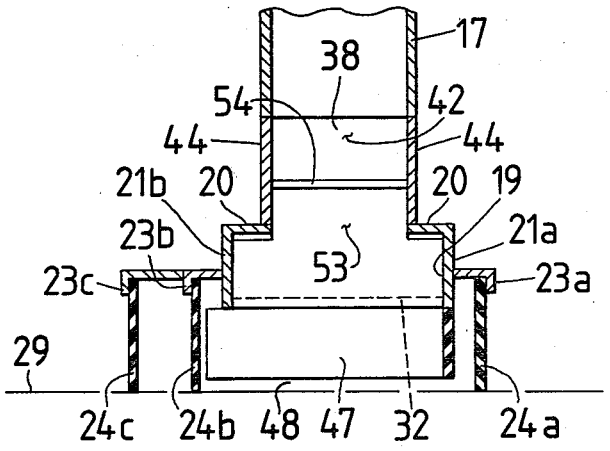
FIG. 5 is an enlarged sectional view taken generally along the line 5—5 of FIG. 3.

My improved pick-up head 14 embodies an elongated downwardly opening chamber 19 having a top wall 20, spaced apart depending side walls 21$^a$ and 21$^b$ and end members 22. As shown in FIGS. 5 and 6, three laterally extending members 23$^a$, 23$^b$ and 23$^c$ are secured by suitable means to the side walls 21$^a$ and 21$^b$. A plurality of ground engaging flap members 24$^a$, 24$^b$ and 24$^c$, such as elongated rubber flaps of a desired thickness, depend from the laterally exxtending members 23$^a$, 23$^b$ and 23$^c$ as shown. The flap members are secured to the members 23$^a$, 23$^b$ and 23$^c$ by suitable means and serve to enclose the front side 26 and rear side 28 of the pick-up head 14. As shown, the flap members 24$^a$, 24$^b$ and 24$^c$ are adapted to move over a surface 29 being cleaned whereby dirt and debris may be dislodged for pick-up. Also, the flap members are flexible so that they permit small articles of trash, such as cans and the like, to move under the pick-up head 14 for removal. The end members 22 are secured to the ends of the pick-up head 14 by suitable means and complete the enclosure of the pick-up head, as shown.

Figure 2:
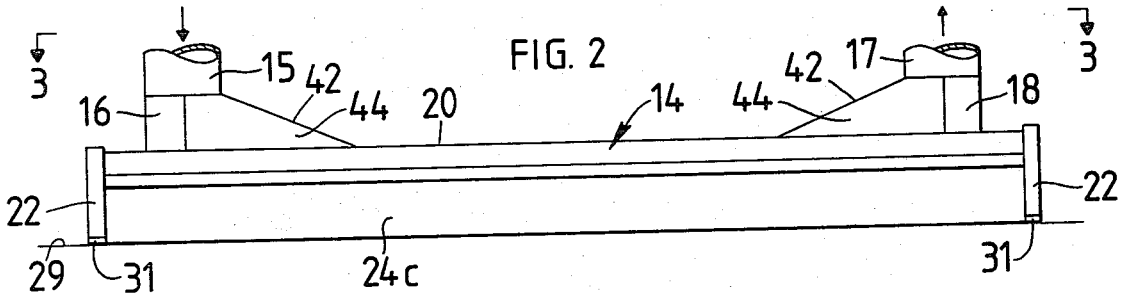
FIG. 2 is an enlarged front elevational view of the pick-up head taken generally along the line 2—2 of FIG. 1.
Figure 4:
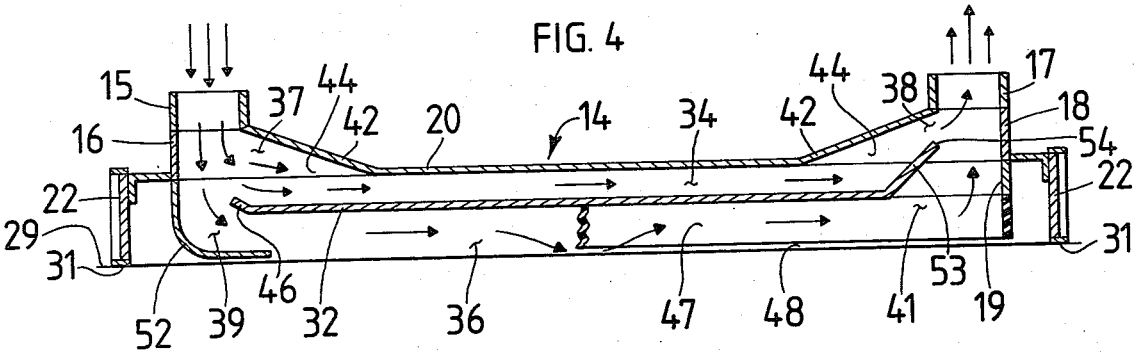
FIG. 4 is a vertical sectional view taken generally along the line 4—4 of FIG. 3.

An elongated skid runner 31 is secured to the lower edge of each end member 22 by suitable means, as shown in FIGS. 1, 2 and 4. The pick-up head 14 is adapted for movement to selected vertical positions with the runners 31 and the flap members 24$^a$, 24$^b$ and 24$^c$ being held in spaced relation above an adjacent surface when the apparatus 10 is not operating and to a position in engagement with the surface 29 to be cleaned when the cleaning device 10 is operating, as shown in FIG. 4. With the runners 31 and the flap members 24$^a$, 24$^b$ and 24$^c$ in the operating position over the surface being cleaned, outside air is drawn into the lower portion of the pick-up head 14, along with lightweight litter and debris, thus eliminating the possibility of air blowing debris outwardly of the pick-up head.

An elongated horizontal baffle 32, such as an elongated plate-like member, extends between the depending side walls 21$^a$ and 21$^b$ of the chamber 19 intermediate the top wall 20 and the surface 29 to be cleaned, as shown in FIGS. 4, 5 and 6. The baffle 32 is secured between the side walls 21$^a$ and 21$^b$ by suitable means, such as by welding and defines an upper air passageway 34 between the top wall 20 and the baffle 32. A lower air passageway 36 is defined between the baffle 32 and the adjacent surface 29 being cleaned and within the confines of the ground engaging flap members 24$^a$, 24$^b$ and 24$^c$, as shown. The upper passageway 34 has an inlet 37 and an outlet 38 at opposite ends thereof which are superimposed over and communicate with an inlet 39 and an outlet 41 for the lower passageway 36, as shown in FIG. 4.

The top wall 20 of the pick-up head 14 is provided with a downwardly and inwardly extending section 42 adjacent the air inlet conduit 16 and adjacent the suction conduit 18, as shown. Each section 42 is narrower in width than the top wall 20 and is defined by a sloping top member and depending side members 44 which are secured to the top wall 20 by suitable means, such as by welding. The section 42 adjacent the inlet conduit 16 forms an enlarged opening for the inlet 37 which allows air from the pressure side of the fan 13 to enter the upper and lower passageways 34 and 36, respectively, as shown. An upturned member 46 carried by one end of the baffle 32 aids in deflecting a portion of the air flowing through the conduit 15 into the upper passageway 34. As air enters each passageway 34 and 36, it flows substantially in a single direction toward its outlet thereof.

Figure 3:
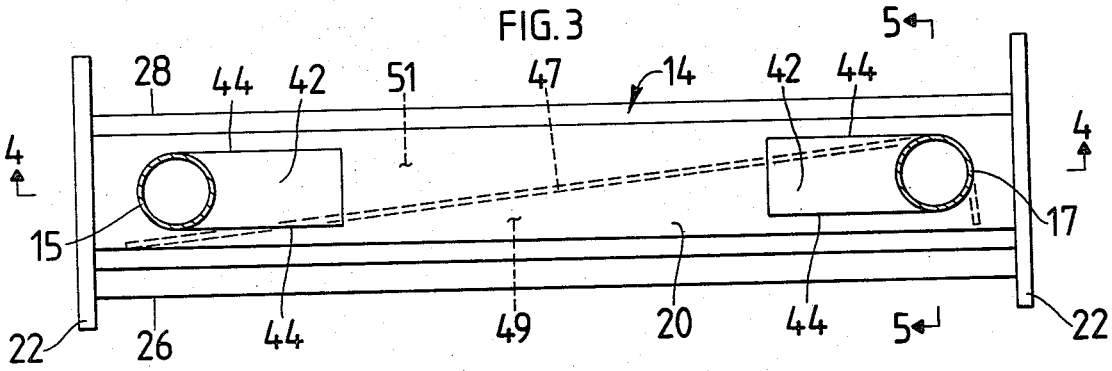
FIG. 3 is a top plan view thereof taken generally along the line 3—3 of FIG. 2.

An additional elongated flexible flap member 47 depends from the baffle 32 into the lower passageway 36 as shown in FIGS. 3, 4 and 5. The flap member 47 terminates in spaced relation above the surface 29 being cleaned to define an opening 48 between the lower edge of the member 47 and the surface 29. Preferably, the lower edge of the flap member 47 is located approximately one inch above the surface 29. Air from the inlet 39 of the lower passageway 36 flows at an increased velocity through the opening 48 and creates a jet-like cleaning action as it engages the surface 29 thereby loosening dirt and debris for pick-up.

As shown in the drawings, the flap member 47 extends diagonally across the lower passageway 36, thereby dividing it into a front portion 49 and a rear portion 51. Air from the inlet 39 of the lower passageway 36 enters the rear portion 51 and flows through the opening 48 defined between the lower edge of flap member 47 and the surface 29 and then into the front portion 49. Some back pressure is thus created within the rear portion 51, thus forcing an increased volume of air into the upper passageway 34. As shown in FIG. 5, the ground engaging member 24$^a$ is of a greater thickness than the ground engaging members 24$^b$ and 24$^c$ so as to substantially prevent air from escaping the rear portion 51 of the lower passageway 36. At the same time the member 24$^a$ is flexible enough to allow large articles, such as rocks, bricks and the like which may come under the pick-up head to move outwardly thereof.

A turning vane 52 which may be in the form of a curved plate-like member is carried by the pick-up head 14 adjacent the inlet 39 for the lower passageway 36, as shown. The vane member 52 is positioned in the inlet conduit 16 to turn the air flowing through the inlet 39 toward the opening 48 in the lower passageway 36. While I have shown the turning vane 52 as being a curved plate-like member, it will be apparent that turning vanes of other shapes and forms may be employed.

As shown in FIGS. 4 and 6, an upturned member 53 is carried by the other end of the baffle 32 to restrict the cross sectional area of the outlet 38 for the upper passageway 34. That is, the upper end portion 54 of the upturned member 53 extends between the side members 44 of the adjacent downwardly and inwardly extending section 42, as shown. The upper end portion 54 terminates at an elevation above the top wall 20 and defines a restriction at the outlet 38, which is smaller than the cross sectional area of the upper passageway 34. Air thus exiting the upper passageway 34 flows at an increased velocity from the restricted outlet whereby a venturi effect is created which produces a negative pressure immediately adjacent the outlet 38. This induced negative pressure together with the negative pressure at the suction side of the fan 13 produces a suction in the front portion 49 of the lower passageway 36 which is greater than the suction created by the fan 13. The increased suction draws outside air and lightweight litter and debris inwardly of the front portion 49 of the lower passageway 36. As the mixture of air under pressure, outside air, lightweight litter and debris moves through the lower passageway 36, it is turned in a direction to exit the pick-up head 14 by the suction of the fan 13. The mixture is thus pulled into collection chamber 12 where the litter and debris are separated from the air by suitable filter means. The air is thus cleaned for recirculation from the pressure side of the fan 13 to the pick-up head 14.

Figure 7:
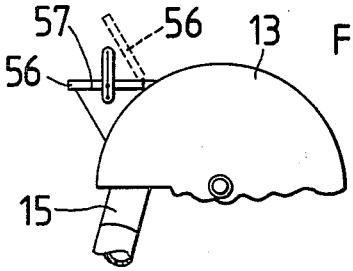

As shown in FIG. 7, a removable cover plate 56 closes an opening 57 in the housing of the fan 13 intermediate the pressure side thereof and the inlet conduit 16. During wet weather and non-dusty conditions, the cover plate 56 may be opened to release or bleed off small volumes of air from the fan 13. This reduces the volume of air entering the pick-up head 14, whereby less resistive back pressure is created at the inlets 37 and 39 of the upper and lower passageways 34 and 36, respectively. Accordingly, more outside air is drawn into the lower passageway 36 as make up air for the system, thus resulting in more suction within the pick-up head 14.

From the foregoing description, the operation of my improved pick-up head for surface cleaning apparatus will be readily understood. With the cleaning apparatus 10 mounted on a vehicle such as the truck 11 and the pick-up head 14 lowered to the cleaning position over the surface 29 to be cleaned, as shown in FIG. 4, air under pressure is delivered from the pressure side of the fan 13 through the duct 15 into the pick-up head 14. As the air enters the pick-up head 14, separate volumes thereof are diverted into the upper and lower air passageways due to the size and arrangement of the inlets 37 and 39. The air in each of the passageways 34 and 36 then flows substantially in a single direction toward its outlet with the air in the lower passageway 36 flowing through the opening 48 to create a jet-like cleaning action on the surface 29 being cleaned, thus dislodging and moving lightweight litter, dirt, debris and the like toward the suction conduit 18. Air in the upper passageway 34 flows toward its outlet 38, where it passes through the restricted area of the passageway 34 defined by upturned member 53 to create a venturi effect as the air passes from the outlet 38. A negative pressure is thus created by the venturi effect, which together with the suction of the fan 13 provides increased suction within the pick-up head 14. With this increased suction and the substantially single direction of flow of the air in the lower passageway 36, lightweight litter, dirt, debris and the like are drawn within the front portion 49 of the pick-up head 14 along with a small volume of outside air. The dirt, debris and the like then flow toward the outlet 41 of the passageway 36 where they are turned in a direction to exit the pick-up 14 as shown. During wet weather or non-dusty conditions, the cover plate 56 may be removed from the opening 57 to allow a portion of the air discharged from the pressure side of fan 13 to escape to the atmosphere. This reduces the volume of air entering the pick-up head 14 whereby less resistive back pressure is created at the inlets 37 and 39. More outside air is thus drawn into the lower passageway to increase the negative pressure within the pick-up head 14.

From the foregoing, it will be seen that I have devised an improved pick-up head for surface cleaning apparatus which is simple of construction and economical of manufacture. Also, my pick-up head provides an improved air flow path which allows lightweight litter, debris and the like to be drawn inwardly of the pick-up head instead of being blown outwardly thereof by blasts of air escaping the pick-up head.

While I have shown my invention in but one form, it will be obvious to those skilled in the art that it is not so limited, but is susceptible of various changes and modifications without departing from the spirit thereof.

What I claim is:

1. In an elongated, downwardly opening pick-up head for an air flow surface cleaning apparatus adapted for movement over a surface to be cleaned and extending transversely of the direction of movement thereof, with said pick-up head having a top wall connected to depending side walls and with one end portion of said pick-up head communicating with the pressure side of an air circulating means and the other end portion thereof communicating with the suction side of said air circulating means, (a) an elongated horizontal baffle extending between said depending side walls of said pick-up head in spaced relation to said top wall and defining an upper passageway having an inlet in communication with said pressure side of said air circulating means and an outlet in communication with said suction side thereof and defining a lower passageway between said baffle and the surface to be cleaned having an inlet communicating with said pressure side of said air circulating means and an outlet communicating with said suction side thereof and with the outlets of said upper and lower passageways discharging into a common conduit communicating with said suction side, and (b) the cross sectional area of said outlet for said upper passageway being restricted so that the velocity of air passing therefrom is increased to create a venturi effect which aids in drawing air from said lower passageway into said common conduit.

2. A pick-up head for surface cleaning apparatus as defined in claim 1 in which an elongated, flexible flap member depends from said baffle into said lower passageway and terminates in spaced relation to said surface being cleaned to define an opening between the lower edge of said flap member and said surface being cleaned so that air from the inlet of said lower passageway flows at an increased velocity through said opening.

3. A pick-up head for surface cleaning apparatus as defined in claim 1 in which at least one elongated, flexible flap element depends from each said side wall of said pick-up head and engages said surface being cleaned.

4. A pick-up head for surface cleaning apparatus as defined in claim 1 in which the end of said baffle adjacent said one end portion of said pick-up head is in position to deflect separate volumes of air discharged from said pressure side of said air circulating means into the inlets of said upper and lower passageways, with the air in said lower passageway flowing substantially in a direction transversely of the direction of movement of said pick-up head and toward the outlet end of said lower passageway.

5. A pick-up head for surface cleaning apparatus as defined in claim 1 in which an upwardly extending member is carried by the end of said baffle adjacent the outlets for said upper and lower passageways in position to restrict said cross sectional area of said outlet for said upper passageway.

6. A pick-up head for surface cleaning apparatus as defined in claim 1 in which air deflecting means is carried by said common conduit at the outlet of said lower passageway in position to direct air flowing therefrom toward said suction side of said air circulating means.

7. A pick-up head for surface cleaner apparatus as defined in claim 6 in which said air deflecting means is an upwardly curved plate-like member.

8. A pick-up head for surface cleaning apparatus as defined in claim 1 in which a discharge opening having a removable cover is provided between said pressure side of said air circulating means and said one end portion of said pick-up head with said discharge opening permitting a portion of the volume of air discharged from said pressure side to escape to atmosphere when the cover is removed thus reducing the volume of air forced into said pick-up head by said air circulating means.

* * * * *